United States Patent [19]

Gressitt et al.

[11] 4,062,614

[45] Dec. 13, 1977

[54] INSULATION PIERCING SLOTTED BEAM ELECTRICAL CONNECTOR

[75] Inventors: Tillman Johnson Gressitt, Long Valley; Richard O'Regan, Bridgewater, both of N.J.

[73] Assignee: Bell Telephone Laboratories, Incorporated, Murray Hill, N.J.

[21] Appl. No.: 710,019

[22] Filed: July 30, 1976

[51] Int. Cl.[2] ..... H01R 9/08

[52] U.S. Cl. ..... 339/97 R; 339/99 R

[58] Field of Search ..... 339/97 R, 97 P, 98, 339/99 R

[56] References Cited

U.S. PATENT DOCUMENTS

| | | | |
|---|---|---|---|
| 2,647,245 | 7/1953 | Gilbert | 339/99 R |
| 3,434,093 | 3/1969 | Wedekind | 339/99 R |
| 3,761,866 | 9/1973 | Sedlacek | 339/97 P |
| 3,798,587 | 3/1974 | Ellis | 339/97 P |
| 3,820,055 | 6/1974 | Huffnagle | 339/97 P |

FOREIGN PATENT DOCUMENTS

| | | | |
|---|---|---|---|
| 1,364,127 | 5/1964 | France | 339/17 LC |

*Primary Examiner*—Roy Lake
*Assistant Examiner*—Mark S. Bicks
*Attorney, Agent, or Firm*—John W. Fisher

[57] ABSTRACT

An insulation piercing slotted beam connector includes a central base portion which is bifurcated at one end. Each of the furcations has a chisel-like cutting edge at its tip which enables the terminal to pierce through insulation covering a conductor so that the insulation remains intact along an outer edge. The base portion also includes provision whereby the bifurcated end can advantageously laterally yaw upon engagement with the insulation covered conductor to properly align the terminal with an offset conductor for a gastight connection.

9 Claims, 5 Drawing Figures

INSULATION PIERCING SLOTTED BEAM ELECTRICAL CONNECTOR

BACKGROUND OF THE INVENTION

1. Field of the Invention

This invention relates to electrical connectors and, in particular, to a slotted beam electrical connector which utilizes piercing means to effect a connection with a communication service wire.

2. Description of the Prior Art

In a telephone communication system many of the connections between a subscriber's premises and a distribution cable are implemented, for example, with aerial service wires. Because such wires are exposed to a wide range of temperature variations, moisture, wind loading and the like, and because such wires quite frequently must be routed through trees and shrubbery, it is essential that the wires be covered with an insulative material capable of withstanding all of the aforementioned environmental rigors if a reliable connection is to be maintained oven an extended period of time.

As noted in my copending application Ser. No. 710,020, filed of even date with this application, an insulative material which advantageously meets the foregoing requirements is polyvinylchloride. However, at temperatures near 0° F. or lower, polyvinylchloride becomes extremely hard.

In order to effect a relatively rapid termination of an aerial service wire, it would be advantageous to utilize some form of connector which does not require extensive preparation of the wire ends. There are several connectors of this general type which have been disclosed in the prior art. One such connector which relies upon a crushing of the insulation surrounding the conductor to effect a connection is described in U.S. Pat. No. 3,112,147 issued to W. Pferd et al on Nov. 26, 1963. Another prior art connector of this general type is disclosed in U.S. Pat. No. 3,234,498, issued to A. Logan on Feb. 8, 1966. This connector utilizes edges on a pair of jaws to pierce or tear apart the insulation to bite into the conductor. Still other prior art connectors employ a slicing action to cut through the insulation and bite into the conductor. Examples of this type of connector can be found in U.S. Pat. No. 3,521,221, issued to G. V. Lenaerts et al on July 21, 1970, and U.S. Pat. No. 3,798,587, issued to B. C. Ellis, Jr. et al Mar. 19, 1974.

However, none of the aforementioned connectors is capable of crushing, tearing, penetrating or slicing through polyvinylchloride insulation at relatively low temperatures repeatedly without being deformed, misaligned or fractured. Upon the occurrence of any of these latter effects, the connector is no longer capable of providing a reliable termination.

Accordingly, it is one object of the present invention to develop a connector which can be advantageously used to terminate a communication service wire without extensive preparation of the wire ends.

Another object is to provide a connector which is capable of piercing through a hard insulation, such as polyvinylchloride, repeatedly and reliably even at low temperatures.

A further object of the present invention is to configure a connector which pierces through the insulation surrounding a conductor while maintaining the integrity of the insulation about outer edges of the connector for enhancing the tightness of a connection.

Still another object is to develop a connector which can advantageously yaw laterally to ensure proper engagement of the connector with an offset conductor and therefore reduce the possibility of damage to the connector.

Yet a further object of the present invention is to provide a connector which can advantageously accept a predetermined range of wire sizes.

SUMMARY OF THE INVENTION

The foregoing and other objects of the invention are realized in an illustrative embodiment of a slotted beam connector which is capable of effecting an electrical connection with an insulation covered electrical conductor. Such a connector is comprised of a flat sheet of electrically conductive material which is bifurcated from an intermediate base portion to one end. Each of the furcations has a progressively tapered cross section for distributing forces internal thereto to produce a force couple between the furcations. At the end of each furcation are means for piercing through the insulation covering the electrical conductor so that the insulation remains intact along an outer edge of the piercing means. Integral with an inner edge of each furcation are means for abrading contact depressions into opposite sides of the electrical conductor. The abrading means, in conjunction with the force couple, produces a gastight connection between the connector and the conductor even with repeated usage.

Accordingly, it is one feature of the present invention that the connector furcations pierce through the conductor insulation without destroying the integrity of the insulation along an outer edge of the furcations.

Another feature is that the inner edges of each furcation abrade contact depressions into opposite sides of the conductor to ensure a gastight connection therewith.

A further feature of the present invention is that the furcation design results in a distribution of the internal compressive and tensile forces to produce a force couple between the furcations.

Still another feature is that the connector has provision for enabling it to yaw laterally as it engages an insulation covered conductor to ensure proper alignment of the two in a completed connection.

BRIEF DESCRIPTION OF THE DRAWINGS

The aforementioned objects and features of the invention, as well as other objects and features, will be better understood upon a consideration of the following detailed description and the appended claims taken in conjunction with the accompanying drawings in which:

DETAILED DESCRIPTION

Figure 1:
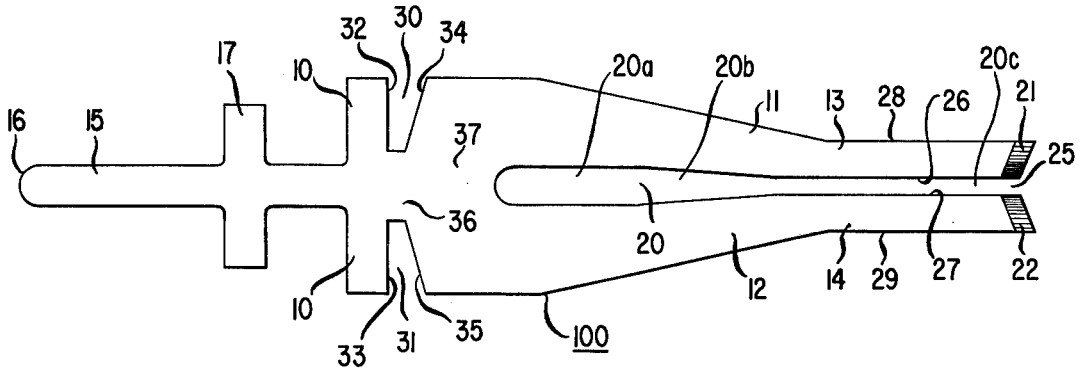
FIG. 1 is a top view of a slotted beam connector.
Figure 2:
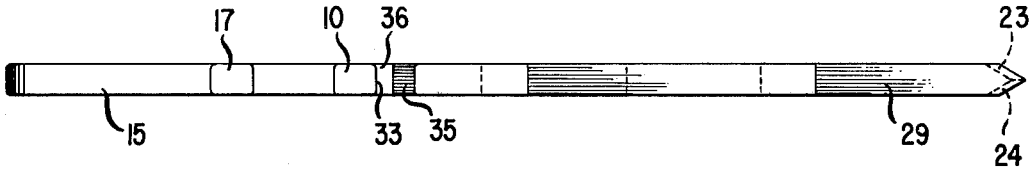
FIG. 2 is a side view of the connector.

A slotted beam connector 100, illustrated by the top and side view of FIGS. 1 and 2, respectively, is comprised of a flat sheet of electrically conductive material. This sheet of material is bifurcated from an intermediate base portion 10 to one end with furcations 11 and 12 resulting therefrom. Each of the furcations 11 and 12 has a progressively tapered cross section which decreases in width from base portion 10 to free ends 13 and 14. Free ends 13 and 14 have width dimensions which ensure adequate insulation between their outer edges and an adjacent conductor in a service wire.

Extending outwardly away from base portion 10 in a direction opposite furcations 11 and 12 is a generally rectangular-shaped member 15 which has at its terminus a generally circular end face 16. Member 15 is advantageously used to accommodate an electrical connection such as, for example, a wire-wrap connection.

At an intermediate point along the length of member 15 is a beam 17 which is spaced apart from base portion 10. Beam 17, in conjunction with the spacing between base portion 10 and beam 17, serves to align the connection 100 in an insulative mounting (not shown).

Furcations 11 and 12 are spaced apart from each other by an elongated slot 20. Slot **20*a*, near the junction of furcations 11 and 12, has a radius of curvature chosen so as to reduce the concentration of stress forces between the furcations when under load. Slot 20*c*, between free ends 13 and 14, has a width dimension which is slightly smaller than a diameter of the smallest gauge wire to be accommodated. Slot 20*b*, which has a variable width dimension, interconnects slots 20*a* and 20*c***.

The width dimension of slot **20*c*, along with the characteristics of the material used to fabricate connector 100, enables connector 100 to accommodate a range of conductor diameters. For example, in the preferred embodiment of connector 100, wire sizes from 18½ gauge to 20 gauge may be advantageously accepted without any permanent deformation or misalignment of furcations 11 and 12. The material characteristics which enable the achievement of this result are a relatively high ratio of yield stress to Young's modulus. Examples of materials having these characteristics are phosphor bronze and spinodal copper. These characteristics permit furcations 11 and 12 to be flexed without exceeding the elastic limit of the material. This, in turn, ensures that connector 100** will effect a reliable termination even upon repeated usage.

At the tips of free ends 13 and 14 are chisel-like cutting edges 21 and 22, respectively. Each of edges 21 and 22 has first and second side faces 23 and 24, as shown in FIG. 2, which are oriented at angles between 45° and 60° with respect to a top edge of free ends 13 and 14. Furthermore, edges 21 and 22 define a generally V-shaped notch 25 adjacent free ends 13 and 14 for directing an electrical conductor into slot **20*c*. The angular orientation of the arms of V-shaped notch 25 formed by edges 21 and 22 can be advantageously varied between 20° and 45° with respect to a plane perpendicular to an axis of symmetry of connector 100**.

Integral with base portion 10 are a pair of generally V-shaped notches 30 and 31 which enable a lateral yawing of the furcations 11 and 12 as they engage an insulation covered electrical conductor. Notches 30 and 31 have their roots extending into base portion 10 such that first sides 32 and 33 lie in a plane which is generally perpendicular to the axis of symmetry of connector 100. Second sides 34 and 35 lie in a pair of oppositely directed planes which intersect at a point in the plane containing sides 32 and 33.

It should be noted that the roots of notches 30 and 31 are illustrated as having sharp corners. In actual practice such sharp corners would be avoided to simplify the die configuration utilized in the manufacture of connector 100. Also, it should be noted that the spacing between the roots of notches 30 and 31 is such that the thickness of member 36 is somewhat less than the thickness of yoke 37 joining furcations 11 and 12 at their junction point. These dimensions are purposely chosen so that furcations 11 and 12, when laterally yawed to engage a conductor, do so as a unit. This ensures that the dimensions of slot 20 are maintained during a conductor insertion even if the conductor does not perfectly line up with notch 25.

Figure 3:
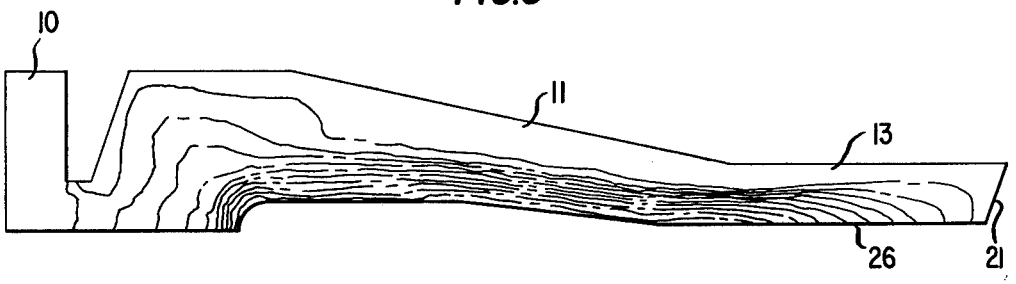
FIG. 3 illustrates lines of constant tensile stress within one of the connector furcations.
Figure 4:
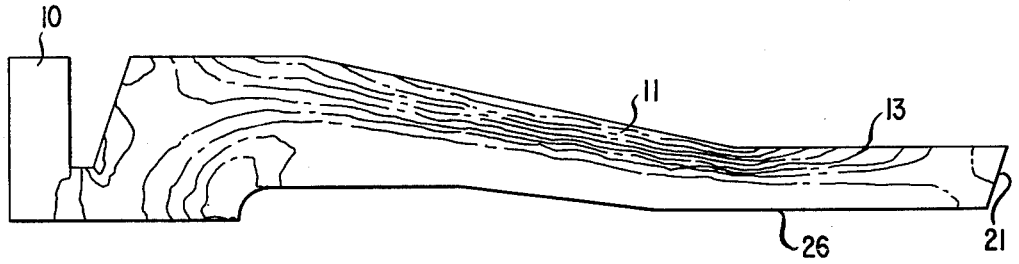
FIG. 4 illustrates lines of constant compressive stress within one of the connector furcations.

FIGS. 3 and 4 illustrate lines of constant tensile and compressive stress within one of the furcations 11 and 12. A set of corresponding lines, mirror imaging those illustrated, are developed in the other furcation. These lines illustrate the distribution of the internal forces within the progressively tapered cross section of furcations 11 and 12 to produce a force couple therebetween. The force couple, in conjunction with edges 27 and 28 on inner surfaces of free ends 13 and 14, abrade contact depressions into opposite sides of an electrical conductor to ensure a gastight connection between the conductor and connector 100.

Figure 5:
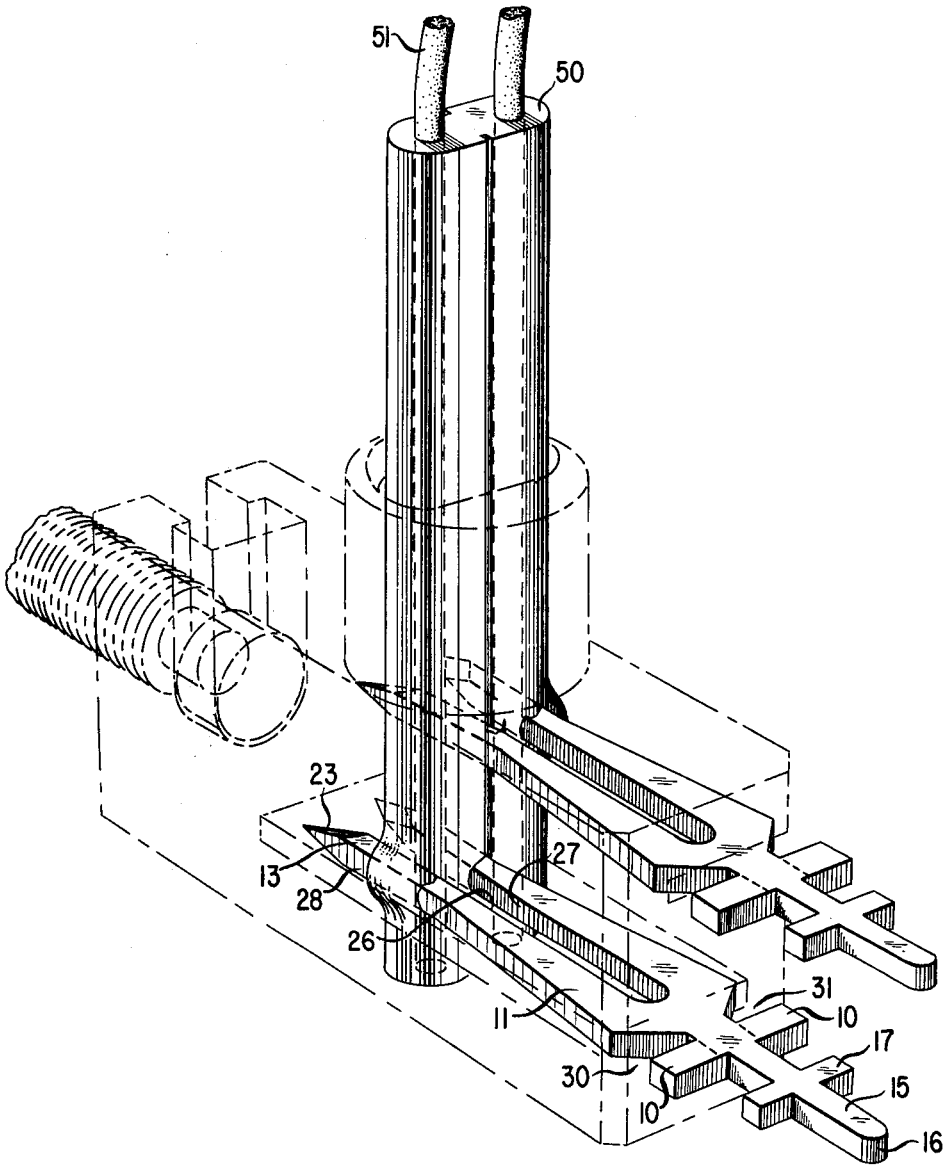
FIG. 5 illustrates an application of the connector for the termination of an aerial communication service wire.

An illustration of an application of connector 100 for terminating an aerial service wire is shown in FIG. 5. A more complete description of a quick connector for service wires is contained in my copending application Ser. No. 710,020 filed of even date with this application. Consequently, a detailed description of the operation of the connector need not be undertaken here. It should be noted, however, that as connector 100 engages insulation 50 surrounding conductor 51, edges 21 and 22 pierce insulation 50 without destroying its integrity along outer edges 28 and 29 of free ends 13 and 14, respectively. Maintaining the integrity of insulation 50 at these points aids in the development of a gastight connection even upon the repeated usage of connector 100.

In all cases it is to be understood that the above-described embodiment is illustrative of but a small number of many possible specific embodiments which can represent applications of the principles of the invention. Thus, numerous and various other embodiments can readily be devised in accordance with these principles by those skilled in the art without departing from the spirit and scope of the invention.

What is claimed is:

1. A slotted beam connector for effecting an electrical connection with an insulation covered electrical conductor including a flat sheet of electrically conductive material bifurcated from an intermediate base portion to one end, each of the furcations having a progressively tapered cross section for distributing forces internal thereto to produce a force couple between said furcations, means, at the end of each furcation, for piercing through said insulation covering said electrical conductor so that said insulation remains intact along an outer edge of said piercing means, means, integral with an inner edge of each furcation, for abrading contact depressions into opposite sides of said electrical conductor, said abrading means and said force couple producing gastight connections between said connector and said electrical conductor upon repeated usage, and means, integral with said base portion, for enabling a lateral yawing of said furcations as they engage said insulation covered electrical conductor, said piercing means, abrading means, and lateral yawing enabling means all lying along a common longitudinal axis of said connector, said enabling means including first and second oppositely directed generally V-shaped notches, roots of said notches extending into said base portion, a first side of each of said notches lying in a plane generally perpendicular to first and second planes containing said abrading means and a second side of said first notch and a second side of said second notch lying in first and second oppositely directed planes, respectively, which intersect at a point in said plane perpendicular to said first and second planes containing said abrading means.

2. The slotted beam connector in accordance with claim 1 further including means, opposite said bifurcated end, for accommodating an electrical connection to said connector, and means, integral with said accommodating means for aligning said connector in an insulative mounting.

3. The slotted beam connector in accordance with claim 2 wherein said furcations are spaced apart from each other by an elongated slot having a radius of curvature at a junction point between said furcations chosen so as to reduce a concentration of stress forces between said furcations when under load, a width dimension at an opposite end which is slightly smaller than a diameter of said electrical conductor and a variable width dimension intermediate the two defined dimensions.

4. The slotted beam connector in accordance with claim 3 wherein said piercing means includes first and second angularly oriented chisel-like cutting edges integral with free ends of said furcations, said edges defining a generally V-shaped notch adjacent said free ends for directing said electrical conductor into said elongated slot with the width dimension slightly smaller than said conductor diameter.

5. The slotted beam connector in accordance with claim 4 wherein said first and second chisel-like cutting edges have first and second side faces oriented at angles between 45° and 60° with respect to a top edge of each of said furcations.

6. The slotted beam connector in accordance with claim 2 wherein said accommodating means includes a generally rectangular-shaped elongated member having at its terminus a generally circular end face, and said aligning means includes a beam member perpendicularly intersecting said elongated member at an intermediate point along its length.

7. A slotted beam connector for effecting an electrical connection with an insulation covered electrical conductor including a flat sheet of electrically conductive material bifurcated from an intermediate base portion to one end, each of the furcations having a progressively tapered cross section for distributing forces internal thereto to produce a force couple between said furcations, and a generally rectangular-shaped elongated member extending outwardly away from said base portion in a direction opposite said furcations, said furcations being spaced apart from each other by an elongated slot having a radius of curvature at a junction point between said furcations chosen so as to reduce a concentration of stress forces between said furcations when under load, a width dimension near the ends of said furcations which is slightly smaller than a diameter of said electrical conductor and a variable width dimension intermediate the two defined dimensions, first and second angularly oriented chisel-like cutting edges, integral with free ends of said furcations, for piercing through said insulation covering said electrical conductor so that said insulation remains intact along an outer edge of said furcations, said edges defining a generally V-shaped notch adjacent said free ends for directing said electrical conductor into said elongated slot having the width dimension slightly smaller than said conductor diameter, inner edges of said furcations for abrading contact depressions into opposite side of said electrical conductor, said contact depressions and said force couple producing gastight connections between said conector and said electrical conductor, and first and second oppositely directed generally V-shaped notches, roots of said notches extending into said base portion, a first side of each of said notches lying in a plane generally perpendicular to first and second planes containing inner edges of said furcations and a second side of said first notch and a second side of said second notch lying in first and second oppositely directed planes, respectively, which intersect at a point in said plane perpendicular to said first mentioned first and second planes, said notches enabling a lateral yawing of said furcations as they engage said insulation covered electrical conductor, said first and second chisel-like cutting edges, said inner edges for abrading contact depressions, and said notches enabling a lateral yawing of said furcations all lying along a common longitudinal axis of said connector.

8. The slotted beam connector in accordance with claim 7 wherein said first and second chisel-like cutting edges have first and second side faces oriented at angles between 45° and 60° with respect to a top edge of each of said furcations.

9. The slotted beam connector in accordance with claim 8 wherein said first and second chisel-like cutting edges are oriented at an angle between 20° and 45° with respect to a plane perpendicular to an axis of symmetry of said connector.

* * * * *